US006137890A

United States Patent [19]

Markow

[11] Patent Number: 6,137,890

[45] Date of Patent: Oct. 24, 2000

[54] LUMPED PARAMETER RESONATOR OF A PIEZOELECTRIC SPEAKER

[75] Inventor: Mitchell Markow, Spring, Tex.

[73] Assignee: Compaq Computer Corporation, Houston, Tex.

[21] Appl. No.: 08/851,990

[22] Filed: May 6, 1997

[51] Int. Cl.[7] ..... H04R 25/00

[52] U.S. Cl. ..... 381/330; 381/190; 381/306

[58] Field of Search ..... 381/306, 333, 381/337, 338, 190; 181/183, 199

[56] References Cited

U.S. PATENT DOCUMENTS

| | | |
|---|---|---|
| 4,352,961 | 10/1982 | Kumada et al. . |
| 4,454,386 | 6/1984 | Koyano . |
| 4,593,160 | 6/1986 | Nakamura . |
| 4,969,197 | 11/1990 | Takaya . |
| 5,031,222 | 7/1991 | Takaya . |
| 5,196,755 | 3/1993 | Shields . |
| 5,424,297 | 6/1995 | Dias et al. . |
| 5,627,901 | 5/1997 | Josephson et al. . |
| 5,638,456 | 6/1997 | Conley et al. . |
| 5,736,808 | 4/1998 | Szilagyi et al. . |
| 5,751,827 | 5/1998 | Takahashi et al. . |
| 5,764,781 | 6/1998 | Ding . |
| 5,796,854 | 8/1998 | Markow . |
| 5,847,922 | 12/1998 | Smith et al. . |

OTHER PUBLICATIONS

*Sound and Structural Vibration, "Sound Radiation by Vibrating Structures,"* Fahy, Frank, Copyright © Academic Press, Inc., 1985, pp. 53–109.

*Theory and Application of Statistical Energy Analysis, "Energy Discription of Vibrating Systems, The Estimation of Response Statistics in Statistical Energy Analysis," and "Energy Sharing by Coupled Systems,"* Lyon, Richard H., and DeJong, Richard G., Copyright © 1995 by Butterworth–Heinemann, pp. 17–107.

*Primary Examiner*—Ping Lee

*Attorney, Agent, or Firm*—Akin, Gump, Strauss, Hauer & Feld, LLP

[57] ABSTRACT

Piezoelectric speaker achieves radiation efficiency at low frequencies by using a piezoelectric speaker panel as a lumped parameter resonator. The speaker panel is mounted in a resonant system for generating translational motion. The resonant system includes suspension devices for suspending the panel to allow for translational motion of the panel and isolators for tuning the speaker panel to a predetermined frequency. At the predetermined frequency, the speaker panel achieves resonance in a low order mode, producing improved radiation efficiency at lower frequencies and translational motion of the panel not possible with a piezoelectric activator alone. The speaker panel may be included in a portable computer system, a desktop computer monitor, or other sound systems. In a portable computer system, a display screen or front speaker panel serves as a lumped parameter resonator, and the lid or rear speaker panel serves as a structure born vibration resonator. The front speaker panel may be driven or excited by coupling a piezoelectric actuator or a plurality of actuators to the front speaker panel, the rear speaker panel, or both panels. When the piezoelectric actuator is coupled to the rear speaker panel, a connection between the panels transfers the vibration energy to the front speaker panel. Further, the actuator or actuators used may be placed at suitable locations on one or both panels.

63 Claims, 6 Drawing Sheets

LUMPED PARAMETER RESONATOR OF A PIEZOELECTRIC SPEAKER

CROSS REFERENCE TO RELATED APPLICATIONS

This application is related to commonly owned and copending application Ser. No. 09/128,728, filed on Aug. 4, 1998, entitled "MULTIPLE CHANNEL SPEAKER SYSTEM FOR A PORTABLE COMPUTER" incorporated by reference herein; commonly owned and copending application Ser. No. 08/810,432, filed on Mar. 4, 1997, now U.S. Pat. No. 5,796,854, entitled "THIN FILM SPEAKER APPARATUS FOR USE IN A THIN FILM VIDEO MONITOR DEVICE" incorporated by reference herein; and commonly owned and copending application Ser. No 08/810,431, filed on Mar. 4, 1997, now U.S. Pat. No. 6,028,944, entitled "POWER AMPLIFIER FOR PORTABLE COMPUTERS" incorporated by reference herein.

BACKGROUND OF THE INVENTION

1. Field of the Invention

The present invention relates to piezoelectric speaker technology, in particular, a lumped parameter resonator of a piezoelectric speaker.

2. Description of the Related Art

With the advent of multimedia computers in laptop computer systems, audio speaker systems providing high quality sound have been integrated into laptop computers. The surface area of laptop computers, however, has been a limiting factor in providing speakers within a laptop computer. Accordingly, laptop computers, particularly laptops having relatively thin dimensions, have switched from diaphragm-type speakers to piezoelectric speakers.

In piezo speaker technology, a piezoelectric actuator placed on a speaker panel converts electrical energy into mechanical energy, thereby driving the speaker panel to achieve a moment or mode and produce acoustic energy. A piezoelectric actuator is a flat strip or disk of ceramic having crystals which stretch and shrink in a transverse direction in response to electrical signals. The transverse motion of the piezoelectric actuator produces transverse motion by the speaker panel allowing the panel, which is typically a polycarbonate sheet, to serve as a structure born vibration resonator. While the transverse movement of the speaker panel is radiation efficient at high frequencies, the transverse movement is radiation inefficient at low frequencies.

In a conventional portable computer having a piezoelectric speaker, pseudo-translational motion is generated by the ends of a speaker panel in addition to the transverse motion of the speaker panel. As a piezoelectric actuator stretches and shrinks, the ends of the speaker panel flex forward and backward. While the pseudo-translational motion is more efficient than transverse motion at low frequencies, the pseudo-translational motion has been subject to wave cancellation. When a speaker panel is placed in a moment or mode, there is compression of air molecules on one side of the speaker panel and refraction of air molecules on the other side of the speaker panel. As a result, both front waves and back waves are produced. At the unbaffled ends or edges of the speaker panel, the front and back waves destructively interfere with one another resulting in zero delta pressure or difference. Zero delta pressure means that the human ear is unable to hear bass since the human ear detects pressure differences. Thus, a conventional portable computer using a piezoelectric speaker has been inefficient at radiating low frequency sounds such as a kick drum or a deep male voice.

A variety of modifications to a piezoelectric speaker panel have been ineffective in eliminating wave cancellation. For instance, sealing up or baffling the sides of a piezo speaker panel has the drawback of reducing speaker panel excursion. Without panel excursion, low frequencies are not radiated. Another modification has been to increase the size of the speaker panel. While using a larger speaker panel reduces the time necessary for front waves and back waves to cancel, the panel has continued to be radiation inefficient below a certain frequency, albeit a lower frequency than for a smaller panel. Yet another modification has been to increase the number of piezoelectric actuators driving the speaker panel. While increasing the number of piezoelectric actuators creates greater speaker panel displacement, the improved radiation efficiency is achieved merely for high frequencies. Another piezo speaker modification has been to use a speaker panel having a material composition with a high degree of stiffness such as aluminum honeycomb. While using a stiffer piezoelectric speaker panel has marginally increased the radiation efficiency of the piezoelectric speaker, a critical frequency has remained at and below which the piezo speaker is radiation inefficient. In addition, using a stiffer piezo speaker panel has the drawback of reducing the number of modes for the speaker panel. Thus, a contemporary piezoelectric speaker has maintained poor radiation efficiency at low frequencies.

Further, a conventional piezoelectric portable computer has included a plastic lid and a display screen forming a frame structure. The plastic lid has been used as a piezoelectric speaker panel by using the plastic lid as a structure born vibration resonator. The display screen, however, has been hard mounted in plastic and has not been used as a piezoelectric speaker panel.

SUMMARY OF THE INVENTION

According to the present invention, a novel piezoelectric speaker is disclosed. The piezoelectric speaker achieves radiation efficiency at low frequencies by using a piezoelectric speaker panel as a lumped parameter resonator. The speaker panel is mounted in a resonant system for generating translational motion. The resonant system includes suspension devices for suspending the panel to allow for translational motion of the panel and isolators for tuning the speaker panel to a predetermined frequency. At the predetermined frequency, the speaker panel achieves resonance in a low order mode, producing improved radiation efficiency at lower frequencies, and achieves translational motion of the panel not possible with a piezoelectric actuator alone. The speaker panel may be included in a portable computer system, a desktop computer monitor, or other sound systems.

In a portable computer system, a display screen or front speaker panel serves as a lumped parameter resonator, and the lid or rear speaker panel serves as a structure born vibration resonator. The front speaker panel may be driven by coupling a piezoelectric actuator or a plurality of piezoelectric actuators to the front speaker panel, the rear speaker panel, or both panels. When a piezoelectric actuator is coupled to the rear speaker panel, a connection between the panels is used to transfer the vibration energy to the front speaker panel. Further, the actuator or actuators used are placed at suitable locations on one or both panels.

BRIEF DESCRIPTION OF THE DRAWINGS

A better understanding of the present invention can be obtained when the following detailed description of the preferred embodiment is considered in conjunction with the following drawings, in which.

DESCRIPTION OF THE PREFERRED EMBODIMENT

Figure 1:
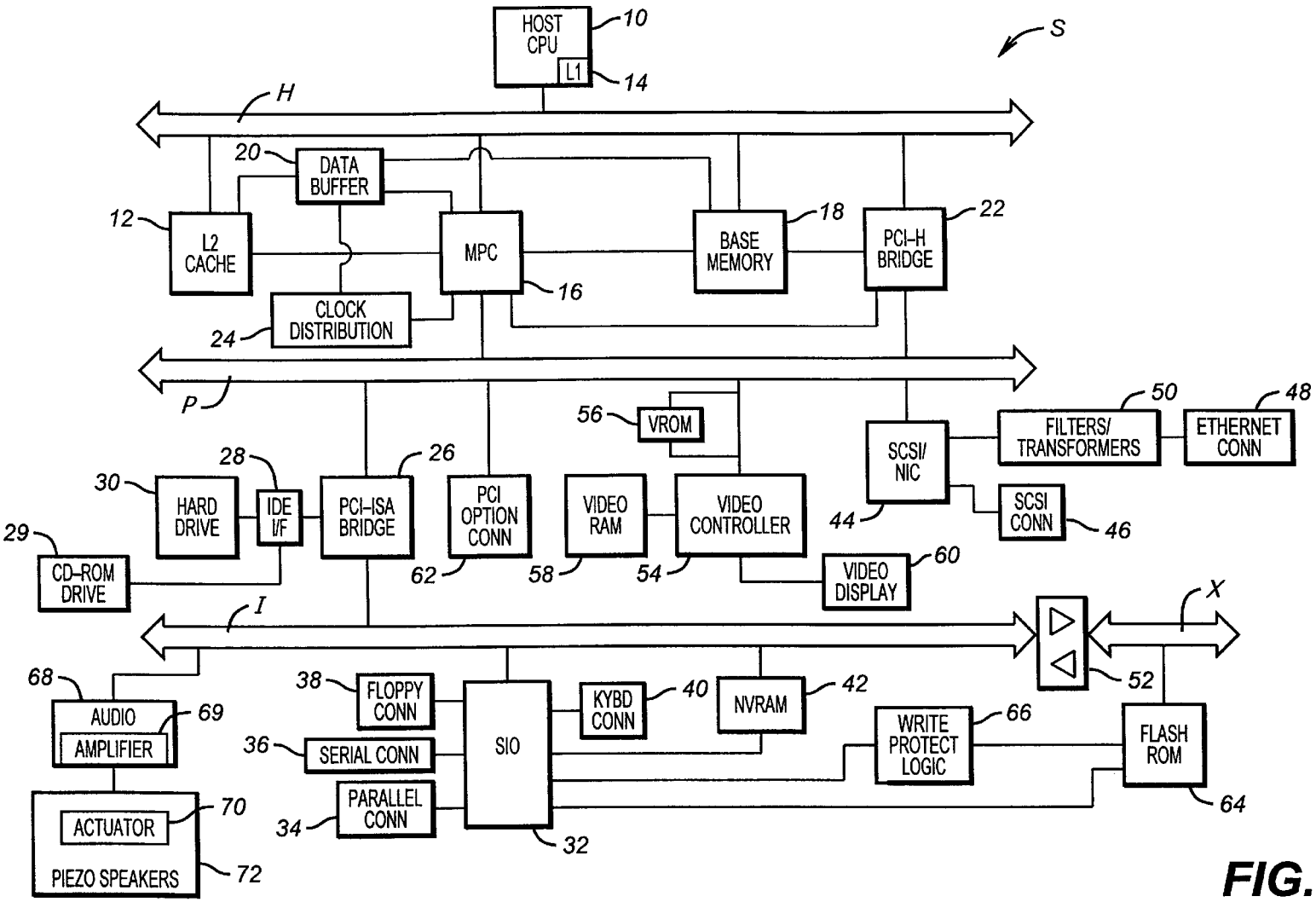
FIG. 1 is a schematic diagram of the computer system of the present invention.

Turning now to the drawings, FIG. 1 shows a multimedia computer system S according to the present invention. Within the computer system S, a CPU 10 and a level two (L2) cache 12 are connected to a high speed host bus H. The processor 10 preferably operates with a standard IBM-PC compatible operating system, such as MS-DOS or Windows. The L2 cache 12 provides additional caching capabilities to the processor's on-chip cache 14 (L1) to improve performance.

In addition to the CPU 10 and caches 12 and 14, a number of memory interface and memory devices are connected between the host bus H and a PCI bus P. These devices include a memory controller 16 such as the memory to PCI cache controller (MPC), a system dynamic random access memory (DRAM) array 18, and a data buffer 20. The memory controller 16 is connected to the host bus H, the PCI-host bridge 22, and the PCI bus P. The memory controller 16 is further connected to clock distribution and generation circuitry 24. The clock circuitry 24, which is connected between the memory controller 16 and the PCI bus P, provides operating timing signals or clocks to the computer system S.

The system DRAM 18 is connected to the host bus H and also connected to the PCI bus P through a PCI-Host bridge 22. The data buffer 20 is connected to the PCI bus P and also connected to the host bus H through the L2 cache 12. The memory controller 16, system DRAM 18, and data buffer 20 collectively form a high performance memory system for the computer system S.

The PCI-Host bridge 22, which is connected to the PCI bus P and the host bus H, is provided to convert signals between the two buses. The PCI-Host bridge 22 includes the necessary address and data buffers, latches, and arbitration and bus master control logic for communication between the host bus H and the PCI bus P.

The input/output bus in the computer system S is preferably the Industry Standard Architecture (ISA) bus I which is connected to the PCI bus P through a PCI to ISA bridge 26. However, it should be understood that other input/output buses may also be used. The PCI to ISA bridge 26 provides various support functions for the computer system S. Preferably the PCI-ISA bridge 26 is a single integrated circuit that acts as a PCI bus master and slave, an ISA bus controller, an ISA write posting buffer, an ISA bus arbiter, DMA devices, and an IDE disk interface. The bridge 26 is also connected to an IDE interface port 28 for driving one or more peripherals such as a hard disk drive 30 and a CD-ROM drive 29. Peripheral devices to store boot data such as a disk drive 30 are used in the initial power-up of the computer system S.

The PCI-ISA bridge 26 is connected to the ISA bus I which is connected to an SIO (super I/O) chip 32. The SIO 32 provides a parallel port 34, a serial port 36, a floppy interface 38, a keyboard interface 40, and a non-volatile random access memory 42 (NVRAM). In addition, a Small Computer Systems Interface (SCSI) and network interface controller (NIC) 44 are connected to the PCI bus P. Preferably the SCSI/NIC 44 is a single integrated circuit and includes the capabilities necessary to act as a PCI bus master or slave and circuitry to act as a SCSI controller and local area network (LAN) or Ethernet interface. A SCSI connector 46 is connected to the controller 44 to allow connection of various SCSI devices, such as hard disk drives and CD-ROM drives. An Ethernet connector 48 is provided also and is connected to filter and transformer circuitry 50 which in turn is connected to the controller 44. This forms a network or Ethernet connection for connecting the computer system S to a local area network (LAN). Also, an external bus X is connected to the ISA bus I through a buffer 52.

Further, an audio card or circuitry 68 including an amplifier 69 is coupled to the ISA bus I or to the PCI bus P. The amplifier is coupled to a piezoelectric actuator or a plurality of piezoelectric actuators 70 of the present invention. While a conventional piezoelectric computer system uses a low voltage amplifier such as a 70 volt amplifier, the computer system S of the present invention preferably includes a high voltage amplifier 69 such as a 250 volt or 300 volt amplifier. In addition, the piezoelectric actuators 70 are coupled to panels of the multimedia computers forming piezoelectric speakers 72 of the present invention. Further, in the present invention, the CD-ROM drive 29 serves as an audio signal generator which provides electrical signals representing a sound for the piezoelectric actuators 70 to convert into acoustic energy.

The computer system S is shown with exemplary video devices. A video controller 54 and video ROM 56 is connected to the PCI bus P. While preferably the video controller 54 is a VGA (video graphics adaptor) controller, other video controllers are known and also may be used. The video controller 54 controls the operation of the video ROM 56, allowing video data to be written, stored, and retrieved as required. The video data may also be temporarily stored in the video RAM 58 which is connected to the video controller 54. The video controller 54 is further connected to a video display screen 60 such as a LCD. The video display screen 60 of the present invention serves as a piezoelectric speaker panel. In addition, a PCI option connector 62 is preferably connected to the PCI bus P. As well, the system S may have a plurality of PCI and ISA type peripherals on their respective buses.

In the computer system S, flash ROM 64 holds the BIOS code. The parallel-access flash ROM 64 is typically located off of the external bus X and is connected to the SIO chip 32. The flash ROM 64 receives its control, address, and data signals from the chip 32. The flash ROM 64 is further connected to write-protect logic 66 which is also connected to the MSIO chip 32.

Figure 2:
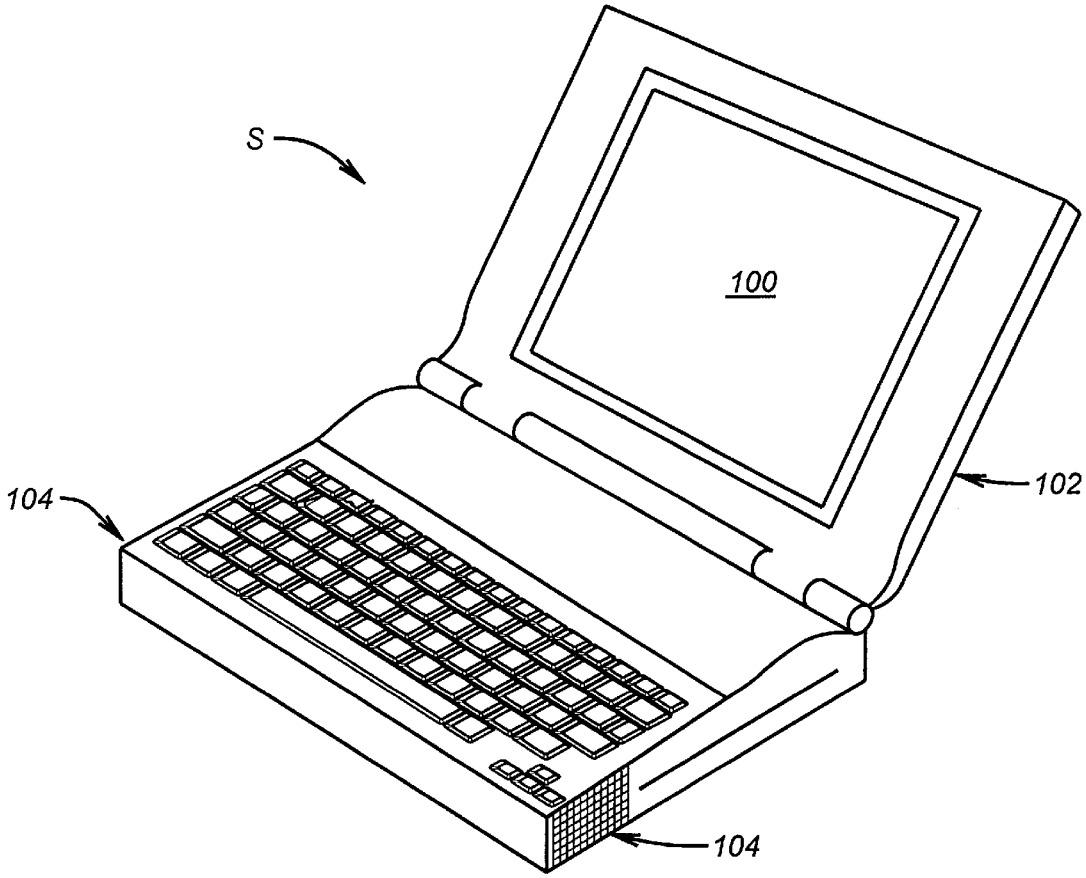
FIG. 2 is an isometric view of the computer system of FIG. 1 contained in a computer system case.

Referring to FIG. 2, a portable computer system S contained in a computer system case is shown. The computer system S includes elements described below which serve as a front speaker panel and a rear speaker panel. In the portable computer S of the present invention, the display screen 100 is used as a front piezoelectric speaker panel and the polycarbonate lid 102 of the portable computer S serves as a rear piezoelectric speaker panel. The portable computer S also includes speaker ports 104 which are preferably located on the sides of the computer case near a user.

Figure 3:
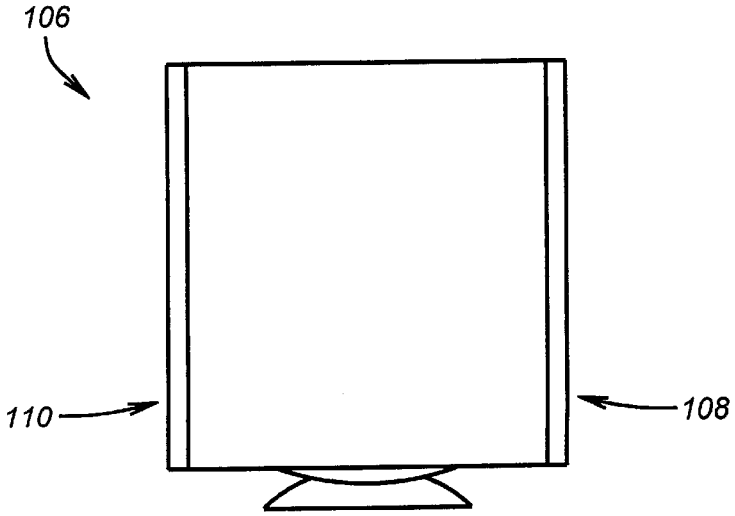
FIG. 3 is a front elevation view of a desktop computer monitor of the present invention.

Referring to FIG. 3, a front elevation view of a monitor 106 of a desktop computer system S of the present invention is shown. The monitor 106 includes two side panels, a left side panel 108 and a right side panel 110. In a desktop monitor 106 of the present invention, both side panels 108 and 110 are preferably used as a piezoelectric speaker panel. Aside from a portable computer and a desktop monitor, the lumped parameter resonator of the present invention may extend to other sound systems having panels such as a CD player, a tape player, or a television.

Figure 4:
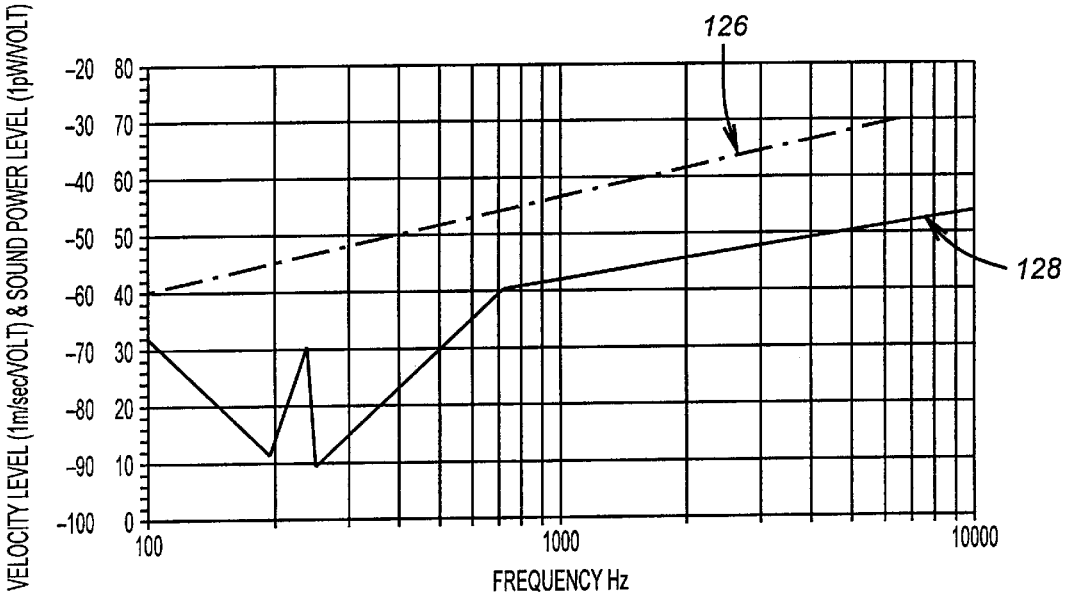
FIG. 4 is a waveform diagram for velocity and sound power of a polycarbonate piezoelectric speaker.

Referring to FIG. 4, a waveform diagram for velocity and sound power of a conventional polycarbonate piezoelectric speaker is shown. A broken or dashed line 126 represents the linear approximation of a velocity response to a typical noise signal over a particular frequency range. The frequency range shown extends from 100 Hz to 10,000 Hz. The velocity waveform 126 indicates the average velocity levels for the front and rear speaker panels and represents acoustic energy which potentially may be radiated by a piezoelectric speaker. The amplitude range for the velocity level is −20 through −100 dB. The solid line 128 represents a linear approximation of sound power generated by a conventional piezoelectric speaker. The amplitude range for sound power is 0 through 80 dB. It should be understood that the amplitudes of the velocity and the sound power signals are exemplary and may differ based on a number of factors, such as the size of the panel, the thickness of the panel, the mass of the panel, the location of the piezoelectric actuators, and the number of piezoelectric actuators.

The difference between the sound power response such as indicated at 128 and the velocity response indicated at 126 represents the radiation efficiency curve of the piezoelectric speaker. The relationship between the velocity response and the acoustic power response reveals that in a conventional piezoelectric speaker, there is a drop-off in radiation efficiency for low frequencies. For the waveforms shown, a rapid drop-off begins at a frequency referred to as a critical frequency between 600 and 700 Hz. The drop-off is illustrative, and the critical frequency varies depending on the parameters of the piezoelectric speaker. For a typical sized notebook computer, the critical frequency is around 300 Hz. The speaker panel of a typical sized notebook computer is 10" by 13" in area. For larger sized notebook computers, there are lower critical frequencies.

Figure 5:
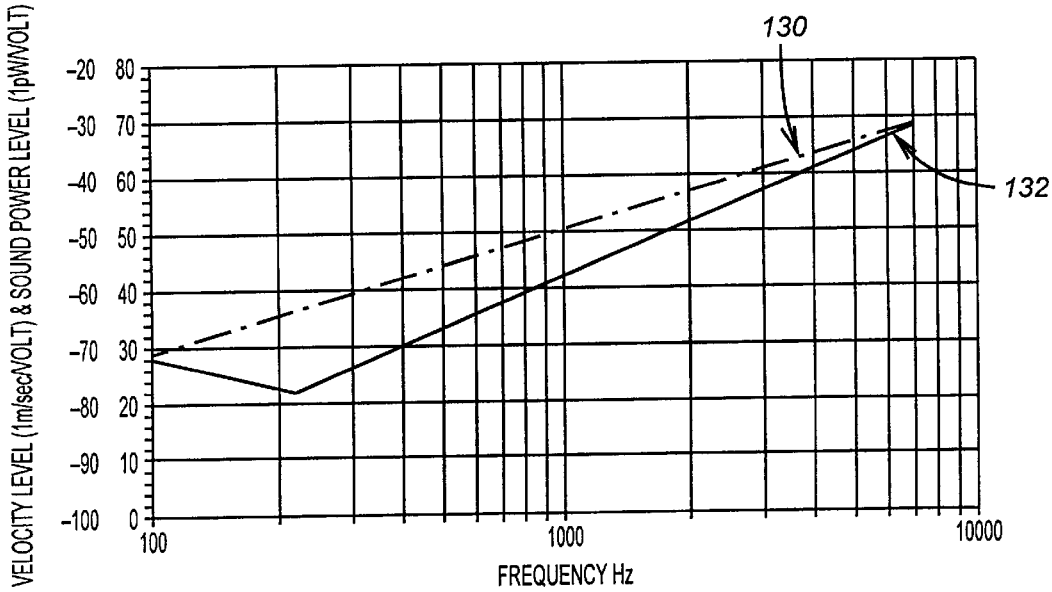
FIG. 5 is a waveform diagram for velocity and sound power of an aluminum honeycomb piezoelectric speaker.

Turning to FIG. 5, a waveform diagram for velocity and sound power of a conventional aluminum honeycomb piezoelectric speaker is shown. A broken line 130 again represents the velocity level which has an amplitude range from −20 to −100 dB. A solid line 132 represents the sound power response for the aluminum honeycomb piezoelectric speaker which has an amplitude range from 0 to 80 dB. Just as with the polycarbonate piezoelectric speaker, the aluminum honeycomb piezoelectric speaker has a frequency drop-off at a critical frequency. However, the critical frequency for the aluminum honeycomb piezoelectric speaker is usually lower than the critical frequency for the polycarbonate piezoelectric speaker. Yet, while the aluminum honeycomb piezoelectric speaker has a higher radiation efficiency than the polycarbonate piezoelectric speaker, both piezoelectric speakers are radiation inefficient at low frequencies.

Figure 6:
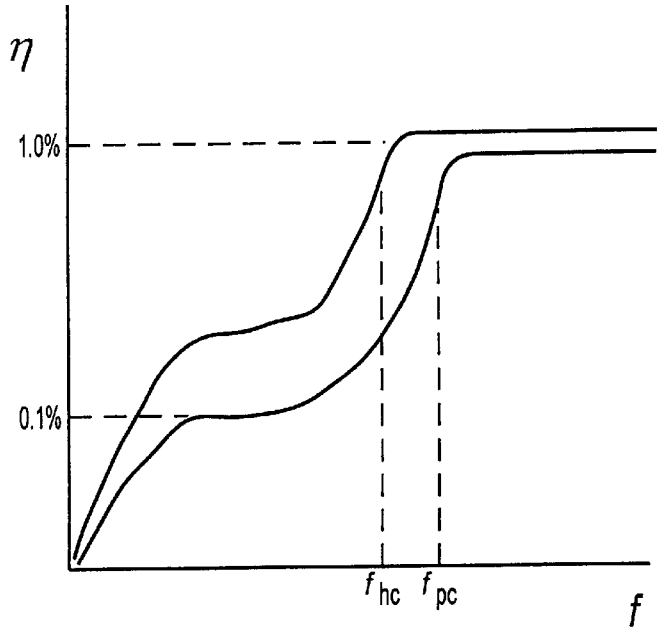
FIG. 6 is a diagram of the radiation efficiencies for a polycarbonate piezo speaker and an aluminum honeycomb piezoelectric speaker.

Turning to FIG. 6, a diagram of the radiation efficiencies $\eta$ for a polycarbonate piezoelectric speaker and an aluminum honeycomb piezoelectric speaker are shown as a function of frequency f. The critical frequency of the polycarbonate piezoelectric speaker is represented as $f_{pc}$, and the critical frequency of the honeycomb piezoelectric speaker is represented as $f_{hc}$. At frequencies above the critical frequencies, the radiation efficiency of both types of piezoelectric speakers is around 1.0 or 100%. At frequencies below the critical frequencies for both types of piezoelectric speakers, the radiation efficiency significantly drops off. At frequencies below the critical frequency, radiation efficiency for both types of piezoelectric speakers approaches 1%.

Figure 7:
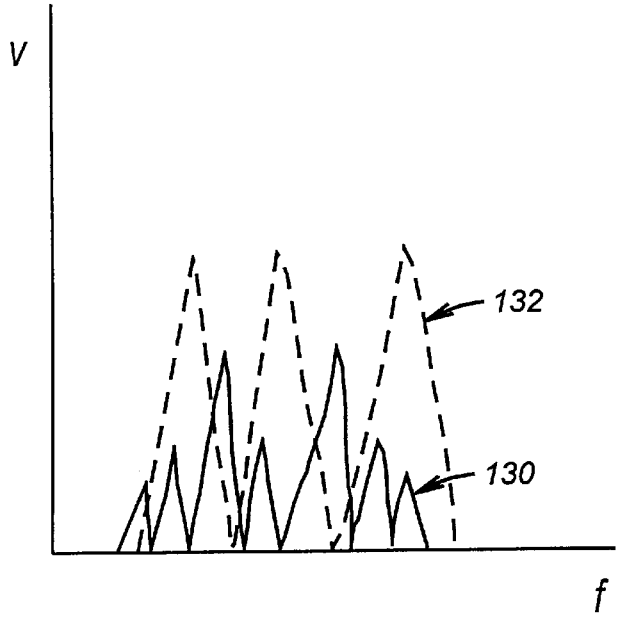
FIG. 7 is a diagram of the velocity modes for a polycarbonate piezo speaker and an aluminum honeycomb piezo speaker.

Turning to FIG. 7, a diagram of the velocity modes for a polycarbonate piezoelectric speaker and an aluminum honeycomb piezoelectric speaker are shown. A solid line 130 represents the velocity modes for the polycarbonate piezoelectric speaker, and a broken line 132 represents the velocity modes for the aluminum honeycomb piezoelectric speaker. Each triangular portion of the velocity waveform represents a mode for the particular piezoelectric speaker. While the aluminum honeycomb piezoelectric speaker allows for higher velocity amplitudes, the aluminum honeycomb piezoelectric speaker has fewer modes than the polycarbonate piezoelectric speaker. For example, with respect to the illustrated waveforms 130 and 132, the polycarbonate piezoelectric speaker can be seen to have seven modes from waveform 130 while the aluminum honeycomb piezoelectric speaker has three modes in waveform 132.

Figure 8:
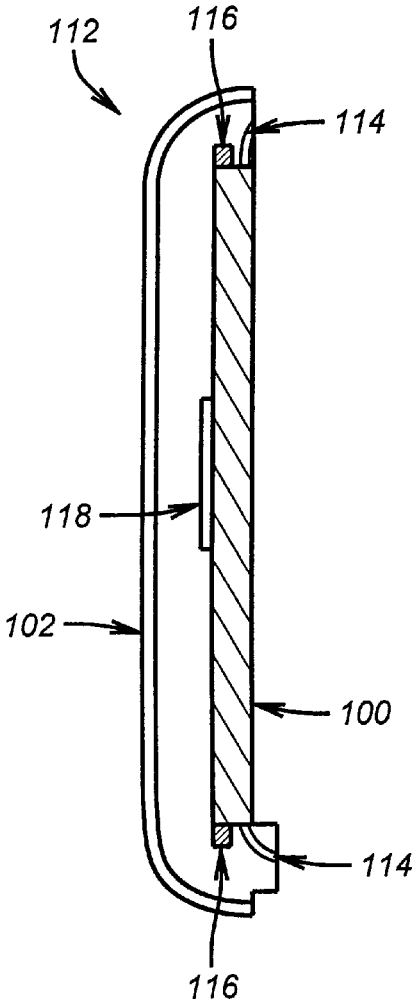
FIG. 8 is a side view taken in cross-section, of a front-panel actuator embodiment of the piezo speaker of the portable computer system of FIG. 1.

Referring to FIG. 8, a front-panel actuator embodiment of the portable computer piezoelectric speaker (FIG. 2) 112 of the present invention is shown in cross-section. The piezoelectric speaker 112 is the same as the piezoelectric speaker 72 in the schematic diagram of FIG. 1. The polycarbonate lid 102 of the portable computer serves as the rear speaker panel, and the display screen 100 of the portable computer serves as the front speaker panel. In a conventional portable computer, the display screen is hard mounted in plastic. A conventional piezoelectric speaker, therefore, relies merely upon the laptop lid to serve as a resonator for generating vibration energy. In the present invention, however, the display screen 100 is an active participant along with the lid 102 in generating vibration energy for the piezoelectric speaker 112. It has been discovered that even in exciting strictly the polycarbonate lid 102 as a speaker panel, some vibration energy is transferred to the display screen 100. To effectively utilize the display screen 100 as a front speaker panel, the display screen is mounted in a resonant system. While the lid 102 is used as a structure born vibration resonator, the resonant system of the present invention uses the display screen 100 as a lumped parameter resonator. This resonant system suspends the display screen 100 using suspension devices 114 and tunes the display screen 100 using isolators 116 to a predetermined frequency for placing the display screen 100 in a low order resonance mode. An example of a suspension device 114 that may be used is a rubber gasket, however, other types of suspension devices 114 are known in the art. Examples of isolators 116 that may be used include springs and rubber mounts, however, other types of isolators 116 are known in the art. For the present invention, it should be understood that the shape, size, and composition of the suspension devices 114 and isolators 116 used may be varied.

In a conventional piezoelectric portable computer, the display screen is allowed to resonate at a number of frequencies. Also, the display screen typically resonates at high frequencies around 1000 Hz. In the present invention, the predetermined frequency to which the display screen 100 is tuned lies in a lower frequency range. The predetermined frequency is the low frequency that suitably fills the radiation efficiency hole or drop-off for the piezoelectric speaker 112 of the present invention. For example, it has been discovered that a frequency between 150 and 250 Hz suitably fills the radiation efficiency hole for a typical sized polycarbonate, piezoelectric-based portable computer. It should be understood that the appropriate frequency or frequency range to fill the radiation efficiency hole for a piezoelectric portable computer is a function of factors such as the size of the speaker panels, the material composition of the panels, the thickness of the panels, and the weight of the panels. Further, the resonance frequency itself is a function of the stiffness of the resonator system, in particular the isolators 116, and the mass of the display screen 100.

The isolators 116 of the resonant system provide a driving force of a predetermined frequency that places the display screen 100 into a low order resonance mode. When the display screen 100 is in a low order resonance mode, radiation efficiency is maximized for sound including low frequency excitations. Thus, the translational motion achieved by the resonant system allows for radiation efficiency at low frequencies. In FIG. 8, two isolators 116 are shown coupled to the display screen 100. The isolators 116 preferably do not contact the lid 102. It should be understood that the number of isolators 116 may be varied in the present invention. Also, a piezoelectric actuator 1 18 having a middle actuator position is shown. It should be understood, however, that the location of the actuator 118 may be varied. Preferably, though, the actuator 118 is located at or near the middle of a speaker panel. A middle actuator location is capable of exciting some low order modes to a greater extent than an off-diagonal location.

Figure 9:
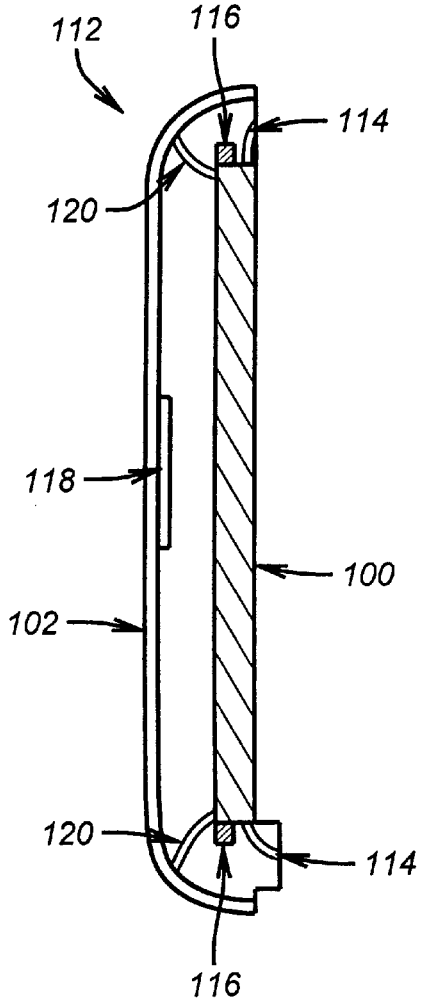
FIG. 9 is a side view, taken in cross-section, of a rear-panel actuator embodiment of the piezoelectric speaker of the portable computer system of FIG. 1.

Referring to FIG. 9, a rear-panel actuator embodiment of the portable computer piezoelectric speaker 112 of the present invention is shown. As in FIG. 8, the polycarbonate lid 102 serves as the rear speaker panel, and the display screen 100 serves as the front speaker panel. The embodiment also includes isolators 116 and suspension devices 114 which serve in a like manner as described above. The piezoelectric actuator 118 is connected to the front speaker panel 100 for the embodiment shown in FIG. 8. In the embodiment of FIG. 9, in contrast, the piezoelectric actuator 118 is connected to the rear speaker panel 102. Epoxy or other known attachment means, either structure or compositions, may be used to connect the actuator 118 to a panel. To transfer the vibration energy received by the rear speaker panel 102 to the front speaker panel 100, the resonant system includes connection devices 120 between the two panels. The connection devices 120 may be flexible or hard, however, hard connections are preferred in order to minimize energy loss. It should be understood that other multi-panel actuator embodiments of the present invention may be achieved by using various combinations of piezoelectric actuators on both the rear speaker panel 102 and the front speaker panel 100.

Figure 10:
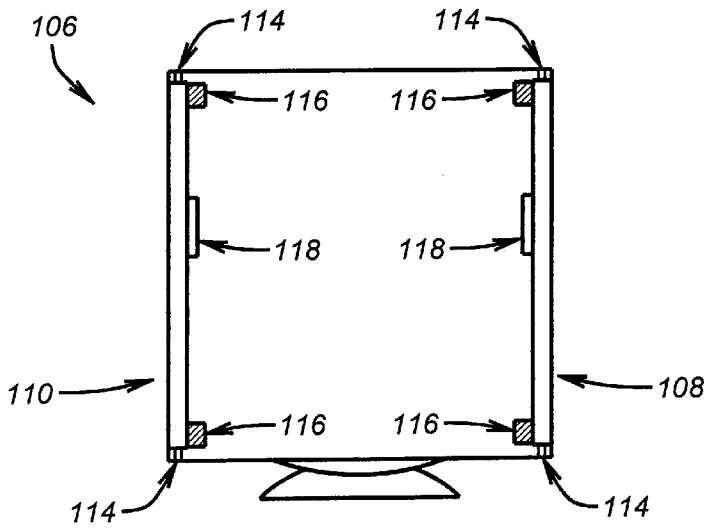
FIG. 10 is a front elevation view of the desktop computer monitor of FIG. 3, with certain portions removed, showing the piezoelectric speaker of the present invention.

Referring to FIG. 10, a desktop computer monitor 106 having piezoelectric speaker panels 108 and 110 of the present invention is shown. The two side panels 108 and 110 of the monitor 106 serve as piezoelectric speaker panels. A piezoelectric actuator 118 for exciting a speaker panel is coupled to each of speaker panels 108 and 110, and isolators 116 for tuning a speaker panel are coupled to each speaker panel 108 and 110. It should be understood that the number of actuators 118 and isolators 116 on each panel may be varied. Both panels 108 and 110 also include suspension devices 114 for suspending a panel. It should be understood that the number of suspension devices 114 on each panel may be varied. The isolators, actuators, and suspension devices of FIG. 10 are formed of like materials to and function like those described above with reference to FIGS. 8 and 9. Accordingly, they bear like reference numerals.

In a conventional piezoelectric portable computer, a wave cancellation problem prevents a resonance mode from being a volume pumping mode. When a speaker panel is placed in a mode that is not a volume pumping mode, there is compression of air molecules on one side of the speaker panel and refraction of air molecules on the other side of the speaker panel. As a result, both front waves and back waves are produced. At the unbaffled ends or edges of the speaker panel, the front and back waves destructively interfere with one another resulting in zero delta pressure. Zero delta pressure means that the human ear is unable to hear bass since the human ear detects pressure differences.

Thus, a conventional portable computer using a piezoelectric speaker lacking a volume pumping mode at low frequencies has been inefficient at radiating low frequency sounds such as a kick drum or a deep male voice. In the present invention, however, volume pumping modes are achieved at low frequencies by mounting a panel in a resonant system, in particular the display screen 100 when the present invention is included in a portable computer.

Figure 11:
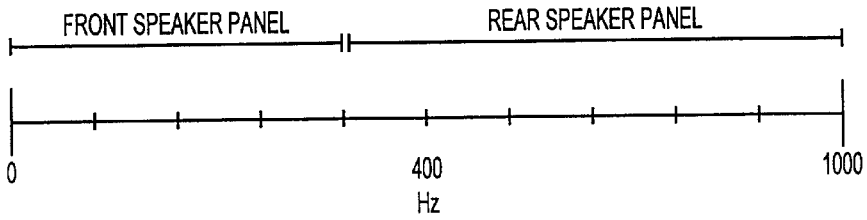
FIG. 11 is an illustration of a resonance band in the audio frequency spectrum of the piezoelectric speaker of the present invention.

Referring to FIG. 11, an illustration of a resonance band in the audio frequency spectrum of the piezoelectric speaker 112 of the present invention is shown. A high frequency resonance band is generated by the rear speaker panel 102 which is used as a structure born vibration resonator. A low frequency resonance band is generated by the front speaker panel 100 which is used a lumped parameter resonator. Since a conventional piezoelectric speaker merely includes a rear speaker panel, a conventional piezoelectric speaker does not allow for a low frequency resonance band. In the illustration, the critical frequency, which defines the lowest frequency for the high frequency resonance band and the highest frequency for the low frequency resonance band, is shown as about 500 Hz. This critical frequency is exemplary as the critical frequency varies depending on factors described above.

The frequency range of the low frequency resonance band is a function of the dampening provided by the resonator system of the present invention. The dampening of the resonator is based on the bulk material properties of the isolators 116. The isolators 116 are preferably made of an elastic-type material such as rubber. While the low frequency resonance band shown in FIG. 11 ranges from 0 to 400 Hz, a different frequency band such as one ranging from 200 to 400 Hz may be designed by varying the stiffness and dampening of the isolators 116 used.

Figure 12:
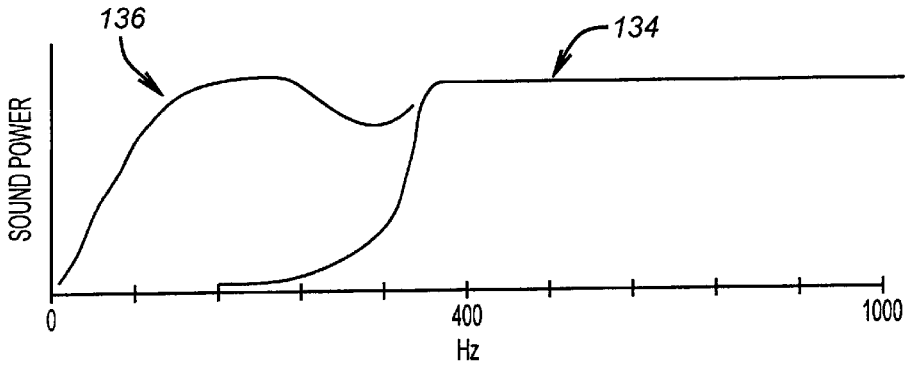
FIG. 12 is a waveform illustration of the sound power of the piezoelectric speaker of the present invention corresponding to the resonance band of FIG. 11.

Referring to FIG. 12, a waveform illustration of the sound power of the piezoelectric speaker 112 of the present invention is shown. The waveform illustration includes a waveform 134 generated by the rear speaker panel 102 and a waveform 134 generated by the front speaker panel 100. The rear speaker panel waveform 134, which corresponds to the high frequency resonance band shown in FIG. 11, lies in a high frequency range. The illustrated rear speaker panel waveform 134 maintains a suitable sound power between 400 and 1000 Hz. At 400 Hz, there is a rapid drop-off for frequencies below 400 Hz. The point of drop-off or critical point is exemplary and varies depending on factors as described above. The front speaker panel waveform 136, corresponding to the low frequency resonance band shown in FIG. 11, lies in a low frequency range. Without the front speaker panel 100, the piezoelectric speaker 112 does not provide a suitable sound power level as illustrated by the drop-off of the rear speaker panel waveform 134. The present invention, however, provides with its front speaker panel 100 a source of acoustic energy or power to fill up the low end of the frequency range. In this way, the display screen 100 of the present invention, like a woofer, achieves radiation efficiency at low frequencies.

Thus, the present invention mounts a panel such as the display screen 100 of a portable computer in a resonant system such that the display screen 100 serves as a lumped parameter resonator. The display screen 100 or panel is thereby tuned to a predetermined frequency for placing the display screen 100 or panel into a low order resonance mode. The lower order resonance mode, which has a resonance band in the low frequencies like a woofer, allows for an improved low-end frequency response and translational motion of the panel not possible with a piezoelectric actuator alone.

Although the invention has been described with reference to its preferred embodiments, those of ordinary skill in the art may, upon reading this disclosure, appreciate changes and modifications which may be made and which do not depart from the scope and spirit of the invention as described above and claimed below.

What is claimed is:

1. A multimedia laptop computer system, comprising:

a first panel capable of vibrating in a transverse direction to produce acoustic energy;

a second panel capable of vibrating in a transverse and translational direction to produce acoustic energy;

a piezoelectric actuator coupled to said second panel for receiving electrical signals indicative of sound and exciting said second panel to vibrate in a transverse direction indicative of sound;

a suspension device coupled to said second panel for suspending said second panel to allow for translational motion of said second panel; and an isolator coupled to said second panel for tuning said second panel to a predetermined frequency placing said second panel in a low order resonance mode.

2. The laptop computer system of claim 1, wherein said first panel is a laptop lid and said second panel is a laptop display screen.

3. The laptop computer system of claim 1, comprising:

a plurality of piezoelectric actuators coupled to said second panel.

4. The laptop computer system of claim 3, further comprising:

a plurality of high voltage amplifiers coupled to said plurality of piezoelectric actuators.

5. The laptop computer system of claim 3, further comprising:

an audio signal generator coupled to said plurality of piezoelectric actuators for providing electrical signals indicative of sound.

6. The laptop computer system of claim 5, wherein the audio signal generator comprises a CD-ROM drive.

7. The laptop computer system of claim 1, further comprising:

a plurality of isolators coupled to said second panel for tuning said second panel to a predetermined frequency placing said second panel in a low order resonance mode.

8. The laptop computer system of claim 1, further comprising:

a plurality of suspension devices coupled to said second panel for suspending said second panel to allow for translational motion of said second panel.

9. The laptop computer system of claim 8, wherein said plurality of suspension devices comprise rubber gaskets.

10. The laptop computer system of claim 1, wherein said suspension device comprises a rubber gasket.

11. The laptop computer system of claim 1, wherein said second panel produces a low frequency resonance band.

12. The laptop computer system of claim 1, wherein said first panel produces a high frequency resonance band.

13. The laptop computer system of claim 1, wherein said second panel, said piezo actuator, and said suspension device form a lumped parameter regulator.

14. The laptop computer system of claim 1, further comprising:

a high voltage amplifier coupled to said piezoelectric actuator.

15. The laptop computer system of claim 1, further comprising:

an audio signal generator coupled to said piezoelectric actuator for providing electrical signals indicative of sound.

16. The laptop computer system of claim 15, wherein the audio signal generator comprises a CD-ROM drive.

17. A multimedia laptop computer system, comprising:

a first panel capable of vibrating in a transverse direction to produce acoustic energy;

a second panel capable of vibrating in a transverse and translational direction to produce acoustic energy;

a connection device coupled between said first panel and said second panel for allowing vibration energy to travel from said first panel to said second panel;

a piezoelectric actuator coupled to said first panel for receiving electrical signal indicative of sound and exciting said first panel to vibrate in a translational direction indicative of sound and exciting said second panel to vibrate in a translational and transverse direction indicative of sound;

a suspension device coupled to said second panel for suspending said second panel to allow for translational motion of said second panel; and an isolator coupled to said second panel for tuning said second panel to a predetermined frequency placing said second panel in a low order resonance mode.

18. The laptop computer system of claim 17, further comprising:

a plurality of piezoelectric actuators coupled to said front panel for receiving electrical signals indicative of sound and exciting said first panel to vibrate in a translational direction indicative of sound and exciting said second panel to vibrate in a translational direction indicative of sound.

19. The laptop computer system of claim 18, further comprising:

a plurality of high voltage amplifiers coupled to said plurality of piezoelectric actuators.

20. The laptop computer system of claim 18, further comprising:

an audio signal generator coupled to said plurality of piezoelectric actuators for providing electrical signals indicative of sound.

21. The laptop computer system of claim 20, wherein the audio signal generator comprises a CD-ROM drive.

22. The laptop computer system of claim 17, further comprising:

a plurality of isolators coupled to said second panel for tuning said second panel to a predetermined frequency placing said second panel in a low order resonance mode.

23. The laptop computer system of claim 17, further comprising:

a plurality of suspension devices coupled to said second panel for suspending said second panel to allow for translational motion of said second panel.

24. The laptop computer system of claim 23, wherein said plurality of suspension devices comprise rubber gaskets.

25. The laptop computer system of claim 17, wherein said suspension device comprises a rubber gasket.

26. The laptop computer system of claim 17, wherein said second panel produces a low frequency resonance band.

27. The laptop computer system of claim 17, wherein said first panel produces a high frequency resonance band.

28. The laptop computer system of claim 17, wherein said second panel, said piezoelectric actuator, and said suspension device form a lumped parameter resonator.

29. The laptop computer system of claim 17, further comprising:

a high voltage amplifier coupled to said piezoelectric actuator.

30. The laptop computer system of claim 17, wherein said first panel is a laptop lid and said second panel is a laptop display screen.

31. The laptop computer system of claim 17, further comprising:

an audio signal generator coupled to said piezoelectric actuator for providing electrical signals indicative of sound.

32. The laptop computer system of claim 31, wherein the audio signal generator comprises a CD-ROM drive.

33. A method of generating a low frequency resonance response from a panel using a piezoelectric actuator, comprising the steps of:

suspending the panel to allow the panel to resonate in a translational direction;

exciting the panel with a piezoelectric actuator to vibrate in a transverse direction and a translational direction indicative of sound; and tuning the panel to a low order resonance frequency.

34. The method of claim 33, wherein the panel is a display screen of a laptop computer system.

35. The method of claim 33, wherein the panel is a side wall of a computer monitor.

36. The method of claim 33, further comprising the step of:

exciting the panel with a plurality of piezoelectric actuators to vibrate in a transverse direction and a translational direction indicative of sound.

37. The method of claim 33, further comprising the step of:

providing an electrical signal indicative of sound to the piezoelectric actuator.

38. The method of claim 37, further comprising the step of:

amplifying the electrical signal provided to the piezoelectric actuator with a high voltage amplifier.

39. The method of claim 33, further comprising:

dampening the panel to define a low frequency resonance band for the panel.

40. A piezoelectric speaker apparatus, comprising:

a panel capable of vibrating in a transverse direction and a translational direction to produce acoustic energy;

a piezoelectric actuator coupled to said panel for receiving electrical signals indicative of sound and exciting said panel to vibrate in a transverse direction indicative of the sound;

a suspension device coupled to said panel for suspending said panel to allow for translational motion of said panel; and an isolator coupled to said panel for tuning said panel to a predetermined frequency placing said panel in a low order resonance mode.

41. The speaker apparatus of claim 40, further comprising:

a plurality of piezoelectric actuators coupled to said panel for receiving electrical signals indicative of sound and exciting said panel to vibrate in a transverse direction indicative of the sound.

42. The speaker apparatus of claim 41, further comprising:

a plurality of high voltage amplifiers coupled to said plurality of piezoelectric actuators.

43. The speaker apparatus of claim 41, further comprising:

an audio signal generator coupled to said plurality of piezoelectrical actuators for providing electrical signals indicative of sound.

44. The speaker apparatus of claim 43, wherein the audio signal generator comprises a CD-ROM drive.

45. The speaker apparatus of claim 40, further comprising:

a plurality of isolators coupled to said panel for tuning said panel to a predetermined frequency placing said panel in a low order resonance mode.

46. The speaker apparatus of claim 40, further comprising:

a plurality of suspension devices coupled to said panel for suspending said panel to allow for translational motion of said second panel.

47. The speaker apparatus of claim 46, wherein said plurality of suspension devices comprise rubber gaskets.

48. The speaker apparatus of claim 40, wherein said suspension device comprises a rubber gasket.

49. The speaker apparatus of claim 40, wherein said panel, said actuator, and said suspension device form a lumped parameter resonator.

50. The speaker apparatus of claim 40, wherein said panel produces a low frequency resonance band.

51. The speaker apparatus of claim 40, wherein said panel, said actuator, said isolator, and said suspension device form a lumped parameter resonance system.

52. The speaker apparatus of claim 40, further comprising:

a high voltage amplifier coupled to said piezoelectric actuator.

53. A piezoelectric sound system, comprising:

a plurality of panels capable of vibrating in a transverse direction and a translational direction to produce acoustic energy;

a plurality of piezoelectric actuators coupled to said plurality of panels for receiving electrical signals indicative of sound and exciting said plurality of panels to vibrate in a transverse direction indicative of sound;

a plurality of suspension devices coupled to said plurality of panels for suspending said plurality of panels to allow for translational motion of said plurality of panels; and a plurality of isolators coupled to said plurality of panels for tuning said plurality of panels to a predetermined frequency placing said plurality of panels in a low order resonance mode.

54. The sound system of claim 53, wherein said plurality of panels form side walls for a computer monitor.

55. The sound system of claim 53, wherein said plurality of panels form side walls for a CD player.

56. The sound system of claim 53, wherein said plurality of panels form side walls for a tape player.

57. The sound system of claim 53, wherein said plurality of panels forms side walls for a television.

58. The sound system of claim 53, further comprising:

an audio signal generator coupled to said plurality of piezoelectric actuators for providing electrical signals indicative of sound.

59. The sound system of claim 58, wherein the audio signal generator comprises a CD-ROM drive.

60. The sound system of claim 53, wherein said plurality of suspension devices comprise rubber gaskets.

61. The sound system of claim 53, wherein said plurality of panels, said plurality of actuators, and said plurality of suspension devices form a lumped parameter resonator.

62. The sound system of claim 53, wherein said plurality of panels, said plurality of actuators, and said plurality of suspension devices form a lumped parameter resonance system.

63. The sound system of claim 53, wherein said plurality of panels produce low frequency resonance bands.

* * * * *